US007874461B2

(12) United States Patent
Bae

(10) Patent No.: US 7,874,461 B2
(45) Date of Patent: Jan. 25, 2011

(54) COSMETIC RECEPTACLE

(75) Inventor: Hae Dong Bae, Anyang (KR)

(73) Assignee: Taesung Industrial Co., Ltd., Anyang (KR)

( * ) Notice: Subject to any disclaimer, the term of this patent is extended or adjusted under 35 U.S.C. 154(b) by 597 days.

(21) Appl. No.: 11/968,905

(22) Filed: Jan. 3, 2008

(65) Prior Publication Data

US 2009/0120963 A1 May 14, 2009

(30) Foreign Application Priority Data

Nov. 12, 2007 (KR) ..... 10-2007-0114730

(51) Int. Cl.
*B67B 1/00* (2006.01)

(52) U.S. Cl. ..... 222/153.13; 222/153.11; 222/153.14; 222/182; 222/183; 222/321.9; 222/384; 222/402.11; 222/402.12

(58) Field of Classification Search ..... 222/153.11, 222/153.13–153.14, 182, 183, 184, 321.9, 222/384, 402.11–402.12
See application file for complete search history.

(56) References Cited

U.S. PATENT DOCUMENTS 2,127,040 A * 8/1938 Mann ..... 222/507
3,844,448 A * 10/1974 Sette ..... 222/153.12
5,141,129 A * 8/1992 Jennings ..... 221/154
5,421,487 A * 6/1995 Moretti ..... 222/153.1
6,375,045 B1 * 4/2002 Ki ..... 222/386
2007/0068967 A1 * 3/2007 Kee ..... 222/162
2007/0246484 A1 * 10/2007 Yoshida et al. ..... 222/153.13

* cited by examiner

*Primary Examiner*—Kevin P Shaver
*Assistant Examiner*—Andrew Bainbridge
(74) *Attorney, Agent, or Firm*—Lowe Hauptman Ham & Berner, LLP

(57) ABSTRACT

A cosmetic receptacle includes: a button locking part including a locking operation pipe assembled with an outer surface of an upper end of the outer receptacle so as to rotate respective to the outer receptacle and a stopping protuberance protruding from an inner surface of the upper end of the outer receptacle, a locking operation groove being formed at the locking operation pipe, the locking operation groove including a lock keeping groove arranged at an upper area of the locking operation groove along a horizontal direction, a release keeping groove arranged at a lower area of the locking operation groove along a horizontal direction, and an elevation guide groove connecting the lock keeping groove with the release keeping groove in a linear direction, and a shoulder part including a stopper groove formed on the shoulder part along a longitudinal direction and an elevation leading protuberance formed at an outer surface of the shoulder part, the shoulder part being installed in such a manner that the stopping protuberance is inserted into the stopper groove, and that the elevation leading protuberance is inserted into the locking operation groove.

3 Claims, 20 Drawing Sheets

COSMETIC RECEPTACLE

BACKGROUND OF THE INVENTION

1. Field of the Invention

The present invention relates to a cosmetic receptacle, and more particularly to a cosmetic receptacle having a structure allowing a user to squeeze out liquid cosmetics kept in the receptacle through a pumping operation so as to use it.

2. Description of the Prior Art

In general, liquid cosmetics kept in a receptacle are sold, and a user squeezes a bit of the liquid cosmetics kept in the receptacle so as to use it. In order to achieve this, a cosmetic receptacle having a pumping part was invented and is generally used nowadays.

FIG. 15 is an exploded perspective view illustrating a conventional cosmetic receptacle, and FIG. 16 is a sectional view illustrating a conventional cosmetic receptacle which is assembled.

As shown in these drawings, the conventional cosmetic receptacle includes: a receptacle part 110 including an outer receptacle 111 and an inner receptacle 112 assembled with the interior of the outer receptacle 111; an inner cap 120 assembled with an upper end of the inner receptacle 112; a shoulder part 130 assembled with an upper end of the outer receptacle 111; a button 140 installed at the upper side of the inner cap 120; a pumping part 150 allowing liquid cosmetics kept into the inner receptacle 112 to be squeezed out when a user pushes a button 140; and a button locking part 180 moves a shoulder part 130 respective to the button 140 so as to hold pushing operation of the button 140 when the user pushes it.

The outer receptacle 111 has an upper surface of an opened cylinder-shape, and a rotating guide groove 111*c* is formed at an outer surface of the upper end of the outer receptacle 111 along a circumferential direction.

Also, a ventilating hole 111*e* is formed at a bottom surface of the outer receptacle 111.

The inner receptacle 112 includes an inner receptacle body part 112*a* of a pipe-shape and a neck part 112*b* formed at an upper end of the inner receptacle body part 112*a*.

The inner receptacle 112 having such a structure is mounted within the outer receptacle 111 in such a manner that an upper surface opening part of the inner receptacle 112 is arranged in the same direction as an upper surface opening part of the outer receptacle 111.

The inner cap 120 includes a supporting pipe part 121, cap skirt part 122 extending form the upper end of the supporting pipe part 121 so as to surround the supporting pipe part 121, and an elevation guide pipe 123 extending from the cap skirt part 122 while having an erect shape.

A supporting pipe part 121 has a communicating hole 121*a* formed through the entire length of the supporting pipe part 121.

The cap skirt part 122 has a cylinder fixing groove 122*b* opened toward the inner receptacle 112.

The inner cap 120 having such a structure is assembled with an outer surface of the neck part 112*b* by a screw through an inner surface of the cap skirt part 122 in a state where the supporting pipe part 121 enters the interior of the neck part 112*b*.

Accordingly, the communicating hole 121*a* communicates with the inner space of the inner receptacle 112, the upper surface opening part of the inner receptacle 112 is closed by the inner cap 120, and the inner cap 120 can move together with the inner receptacle 112.

The shoulder part 130 includes a shoulder body part 131 having a pipe-shape and a seating flange 133 bent from the upper end of the shoulder body part 131 toward the center thereof.

The shoulder body part 131 has a pair of stopping elongated holes 131*a* formed thereon along a longitudinal direction and a rotating guide protuberance 131*c* formed at the inner surface thereof in such a manner as to correspond to the rotating guide groove 111*c*.

A mounting hole 133*a* is formed at an inner side of the seating flange 133, and a seating groove 133*b* is formed on an upper surface of the seating flange 133. The shoulder part 130 having such a structure is installed in such a manner that the rotating guide protuberance 131*c* enters the rotating guide groove 111*c* in a state where a mounting hole 133*a* is arranged at the upper side of the communicating hole 121*a*, and in a state where each elevation guide protuberance 183, which will be described below, is inserted into each elongated hole 131*a*.

Accordingly, the shoulder part 130 can rotate respective to the outer receptacle 111.

The button 140 has a discharging channel 140*a* which is formed at the interior of the button 140 and is opened through a side surface and a lower surface thereof.

Also, the button 40 has a shaft fixing groove part 141 extending from the lower surface of the button 140 in a longitudinal direction of the outer receptacle 111, and an elevation operating pipe 142 is formed at a peripheral area of the shaft fixing groove part 141.

The button 140 having such a structure is installed in such a manner that the upper end of a guide shaft 171, which will be described below, is fixedly inserted into the shaft fixing groove part 141 in a state where the elevation operating pipe 142 is arranged at the inner side of the elevation guide pipe 123.

Accordingly, the button 140 is interlocked with the guide shaft 171 performing an elevation operation so that the button 140 approaches or moves away from the inner cap 120 in a state where the lower opened end of the discharging channel 140*a* is positioned toward the communicating hole 121*a*.

The pumping part 150 includes a cylinder 151 assembled with the shoulder part 130, a guide channel part 160 having a guide channel connecting the discharging channel 140*a* with the inner space of the cylinder 151, a return spring 152 installed at the interior of the cylinder 151, a valve body 153, and a receptacle piston 154 installed at the interior of the inner receptacle 112.

The cylinder 151 has a inflow hole 151*a* formed at the lower surface thereof and a opening part formed at the upper surface thereof.

Also, a fixing wall part 151*b* is formed at the cylinder 151 so as to surround the upper surface opening part.

The cylinder 151 having such a structure can be assembled with the inner cap 120 by fixedly inserting the fixing wall part 151*b* into a cylinder fixing groove 122*b* in a state where the upper surface opening part communicates with the communicating hole 121*a*.

The guide channel 160 includes a guide pipe 170 installed in such a manner as to enter the inner space of the cylinder 151 and a cylinder piston 161 installed at the interior of the cylinder 151.

The guide pipe 170 includes a guide shaft 171 having a shaft hole 171*a* formed thereon and a guide stem 172 installed in such a manner that an upper end thereof is inserted into the shaft hole 171*a*.

The shaft hole 171*a* is formed through the entire length of the guide shaft 171.

A stem supporting jaw 171*b* is formed at an inner circumferential surface of the shaft hole 171*a*.

The guide shaft 171 having such a structure is installed in such a manner that the lower end thereof passes through the communicating hole 121*a* so as to enter the inner space of the cylinder 151.

The guide stem 172 has a stem cut part 172*a* formed at the lower part thereof and a stem channel 172*b* formed at the interior thereof so as to communicate with the shaft hole.

The stem cut part 172*a* is formed so as to allow an air gap to be generated between the stem cut part 172*a* and the inner surface of the cylinder 151.

The guide stem 172 having such a structure is inserted into the shaft hole 171*a* in such a manner that the upper end of the guide stem 172 makes contact with the stem supporting jaw 171*b*, and the lower part thereof passes through a passing hole 161*c*, which will be described below.

As such, in a state where the guide pipe 170 is installed, a guide channel is formed in an area between the stem cut part 172*a* and the inner surface of the cylinder 151, in an area between the inner circumferential surface of the passing hole 161*c* and the outer surface of the guide stem 172, and in the upper area of the stem channel 172*b* and the shaft hole 171*a*.

Accordingly, an upper exposed end of the guide channel (the upper and lower ends of the shaft hole are exposed) communicates with the discharging channel 140*a*, and a lower exposed end of the guide channel communicates with the inner space of the cylinder 151.

The cylinder piston 161 includes a cylinder piston body part 161*a* and a cylinder closing pipe 161*b* extending from the entire periphery of the lower end of the cylinder piston body part 161*a* toward the exterior.

The cylinder piston body part 161*a* has a center area at which a passing hole 161*c* is formed.

The cylinder piston 161 having such a structure is installed at the interior of the cylinder 151 in such a manner that a cylinder closing pipe 161*b* makes close contact with the inner surface of the cylinder 151, and the inner circumferential surface of the passing hole 161*c* makes contact with the stem cut part 172*a*.

The return spring 152 is installed in such a manner that both ends are supported by a lower surface of the guide stem 172 and a spring supporting jaw formed while erect on an inner bottom surface of the cylinder 151, respectively.

Accordingly, the return spring 152 can accumulate elastic force when the guide stem 172 moves toward the inflow hole 151*a*.

The valve body 153 has a ball-shape and closes the inflow hole 151*a* by self-road.

The receptacle piston 154 includes a receptacle piston body part 154*a* having a recessed shape and a receptacle closing pipe 154*b* extending from the entire periphery area of the upper end of the receptacle piston 154 to the exterior.

The receptacle piston 154 having such a structure is installed at the interior of the inner receptacle 112 in such a manner that the receptacle closing pipe 154*b* makes close contact with the inner surface of the inner receptacle body part 112*a*.

Accordingly, the receptacle piston 154 closes the lower surface opening part of the inner receptacle 112.

The operation of the pumping part 150 having such a structure will be described below.

When the button 140 is pressed, the guide shaft 171 and the guide stem 172 are moved downward, and the return spring 152 accumulates elastic force.

When the guide stem 172 moves downward, the inner circumferential surface of the passing hole 161*c* is separated from the outer surface of the guide stem 172 so that the guide channel is opened.

When the guide channel is opened, liquid cosmetics contained within the cylinder 151 are discharged through the guide channel and the discharging channel 140*a*.

When virtual pressure respective to the button 140 is released, the button 140, the guide shaft 171, the guide stem 172 return to each initial position by means of elastic force accumulated in the return spring 152.

When the guide stem 172 returns to it's initial position, the inner circumferential surface of the passing hole 161*c* makes contact with the outer surface of the guide stem 172 so that the guide channel is closed.

Meanwhile, when the guide stem 172 returns to its' initial position, negative pressure is generated in the interior of the cylinder 151.

When negative pressure is generated in the interior of the cylinder 151, the suction force is applied in an upper direction so that the inflow hole 151*a* is opened.

When the inflow hole 151*a* is opened, liquid cosmetics kept in the inner receptacle 112 flows into the interior of the cylinder 151.

Meanwhile, when the liquid cosmetics kept in the inner receptacle 112 flow into the interior of the cylinder 151, the receptacle piston 154 moves toward the cylinder 151.

When the button 140 is pressured again, the inflow hole 151*a* is closed by the valve body 153, and the liquid cosmetics in the interior of the cylinder 151 is discharged through the guide channel and the discharging channel 140*a*.

The button locking part 180 includes a locking operation pipe 181 formed at an upper end of the outer receptacle 111, a locking flange 182 which has a ring-shape and extends from an outer surface of the neck part 112*b* outward, and a pair of elevation guide protuberances 183 extending from a periphery part of the locking flange 182.

A pair of lock operation grooves 181*a* is formed at the locking operation pipe 181 with a phase difference of 180 degrees between them.

Each lock operation groove 181*a* includes a lock keeping groove 181*b* arranged at an upper area thereof along a horizontal direction, a release keeping groove 181*c* arranged at a lower area thereof along a horizontal direction, and a elevation guide groove 181*d* connecting the lock keeping groove 181*b* with the release keeping groove 181*c*.

Each elevation guide protuberance 183 is inserted into each lock operation groove 181*a* of the locking operation pipe 181 having such a structure.

A method for using a conventional cosmetic receptacle having such a structure will be described below with reference to FIGS. 17 to 20. In order to achieve convenience in describing, it is assumed that liquid cosmetics are contained in a space between the inner receptacle 112 and the receptacle piston 154, and the elevation protuberances 183 are positioned in the lock keeping groove 181*b* (see FIG. 18).

Firstly, when the user grasps the outer receptacle 111 and rotates the shoulder part 130, the inner cap 120, the inner receptacle 112, and the button 140 are rotated by reciprocal operation between the elevation guide protuberance 183 and the stopping elongated hole 131*a*.

When the inner cap 120 is rotated, the elevation guide protuberance 183 is elevated from the lock keeping groove 181*b* along the elevation guide groove 181*d* and finally enters the release keeping groove 181*c* (see FIG. 18).

While the elevation guide protuberance 183 is elevated from the lock keeping groove 181*b* to the release keeping groove 181*c*, the inner cap 120, the inner receptacle 112, and the button 140 are elevated (see FIG. 17).

In a state where the button 140 is elevated, liquid cosmetics kept in the inner receptacle 112 is discharged by performing the operation of pressing the button 140 and releasing the pressure as described above.

When the user again catches the outer receptacle 111 and rotates the shoulder part 130 in an opposite direction after finishing using cosmetic, the inner cap 120, the inner receptacle 112, and the button 140 are rotated in the opposite direction by reciprocal operation between the elevation guide protuberance 183 and the stopping elongated hole 131*a*.

When the inner cap 120 is rotated in the opposite direction, the elevation guide protuberance 183 is moved downward from the lock keeping groove 181*b* along the elevation guide groove 181*d* so as to finally enter the release keeping groove 181*c* (see FIG. 20).

While the elevation guide protuberance 183 is moved downward from the lock keeping groove 181*b* and enters the release keeping groove 181*c*, the inner cap 120, the inner receptacle 112, and the button 140 are moved downward (see FIG. 19).

In a state where the button 140 has been moved downward, the button 140 makes contact with the seating flange 133.

Also, in a state where the button 140 has been moved downward, the operation of pressing the button 140 cannot be performed.

The conventional cosmetic receptacle having such a structure is disclosed in utility model registration application No. 19430 filed on 2006 (Title: Dispenser Receptacle).

However, according to the conventional cosmetic receptacle, the button 140 is moved respective to the shoulder 130 so as to lock or release pressing operation of the button 140. There is a problem in that the inner receptacle 112 is also elevated together with the button 140 elevating. As such, since the inner receptacle 112 is elevated together with the button 140, there is also another problem in that an initial assembling state of the button 140 and the pumping part 150 can not be stably maintained.

Also, the elevation of the button 140 is performed by rotating the shoulder part 130 in a state where the user holds the outer receptacle 111. Therefore, the operation is inconvenient.

SUMMARY OF THE INVENTION

Accordingly, the present invention has been made to solve the above-mentioned problems occurring in the prior art, and the present invention provides a cosmetic receptacle has a structure where a button can be locked or released through elevation operation of a shoulder part, thereby improving convenience in operation.

In accordance with an aspect of the present invention, there is provided a cosmetic receptacle including: a receptacle part including an outer receptacle having an opening part formed at an upper surface thereof and an inner receptacle which has a opening part formed at an upper surface thereof and is installed within the outer receptacle in such a manner that the upper surface opening part of the inner receptacle part is arranged in a same direction as the upper surface opening part of the outer receptacle part; an inner cap which has a communicating hole and is assembled with an upper end of the inner receptacle so that the inner cap can close the upper surface opening part of the inner receptacle and move together with the inner receptacle in a state where the communicating hole communicates with an inner space of the inner receptacle; a shoulder part which has a mounting hole and is arranged in such a manner that the mounting hole is arranged at an upper side of the communicating hole; a button having a discharging channel formed at an interior of the button, the discharging channel being opened through a side surface and a lower surface of the discharging channel, the button being installed so as to approach and move away from the inner cap in a state where a lower opening end of the discharging channel is positioned toward the communicating hole; a pumping part including a cylinder, which has an opening part formed at an upper surface of the cylinder and is installed in such a manner that the upper surface opening part communicates with the communicating hole, and a guide channel part including a guide channel which connects the discharging channel with an inner space of the cylinder and is interlocked with an pushing operation of the button so as to be opened/closed, the pumping part allowing liquid cosmetics kept within the inner receptacle to be squeezed out through the discharging channel when the button is pressed; a button locking part reciprocally moving the shoulder part respective to the button so as to hold a pushing operation of the button when a user pushes the button, wherein the button locking part includes a locking operation pipe assembled with an outer surface of an upper end of the outer receptacle so as to rotate respective to the outer receptacle and a stopping protuberance protruding from an inner surface of the upper end of the outer receptacle, a locking operation groove being formed at the locking operation pipe, the locking operation groove including a lock keeping groove arranged at an upper area of the locking operation groove along a horizontal direction, a release keeping groove arranged at a lower area of the locking operation groove along a horizontal direction, and an elevation guide groove connecting the lock keeping groove with the release keeping groove in a linear direction, and wherein the shoulder part includes a stopper groove formed on the shoulder part along a longitudinal direction and an elevation leading protuberance formed at an outer surface of the shoulder part, the shoulder part is installed in such a manner that the stopper protuberance is inserted into the stopper groove, and the elevation leading protuberance is inserted into the stopper operation groove.

Herein, so as to make the structure of the outer receptacle simple, it is preferable that the outer receptacle includes an outer receptacle body part having a pipe-shape and a locking ring coupled with an inner surface of an upper end of the outer receptacle body part so as to rotate together with the outer receptacle body part, and the stopper protuberance is formed at an inner surface of the locking ring.

Also, so as to prevent cosmetic from leaking through the discharging channel while being kept, the shoulder part preferably includes a channel closing wall part formed at an upper surface of the shoulder so as to close an opening end of a side surface of the discharging channel when the elevation leading protuberance is inserted into the locking keeping groove.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, the present invention will be described with reference to the following drawings.

Figure 1:
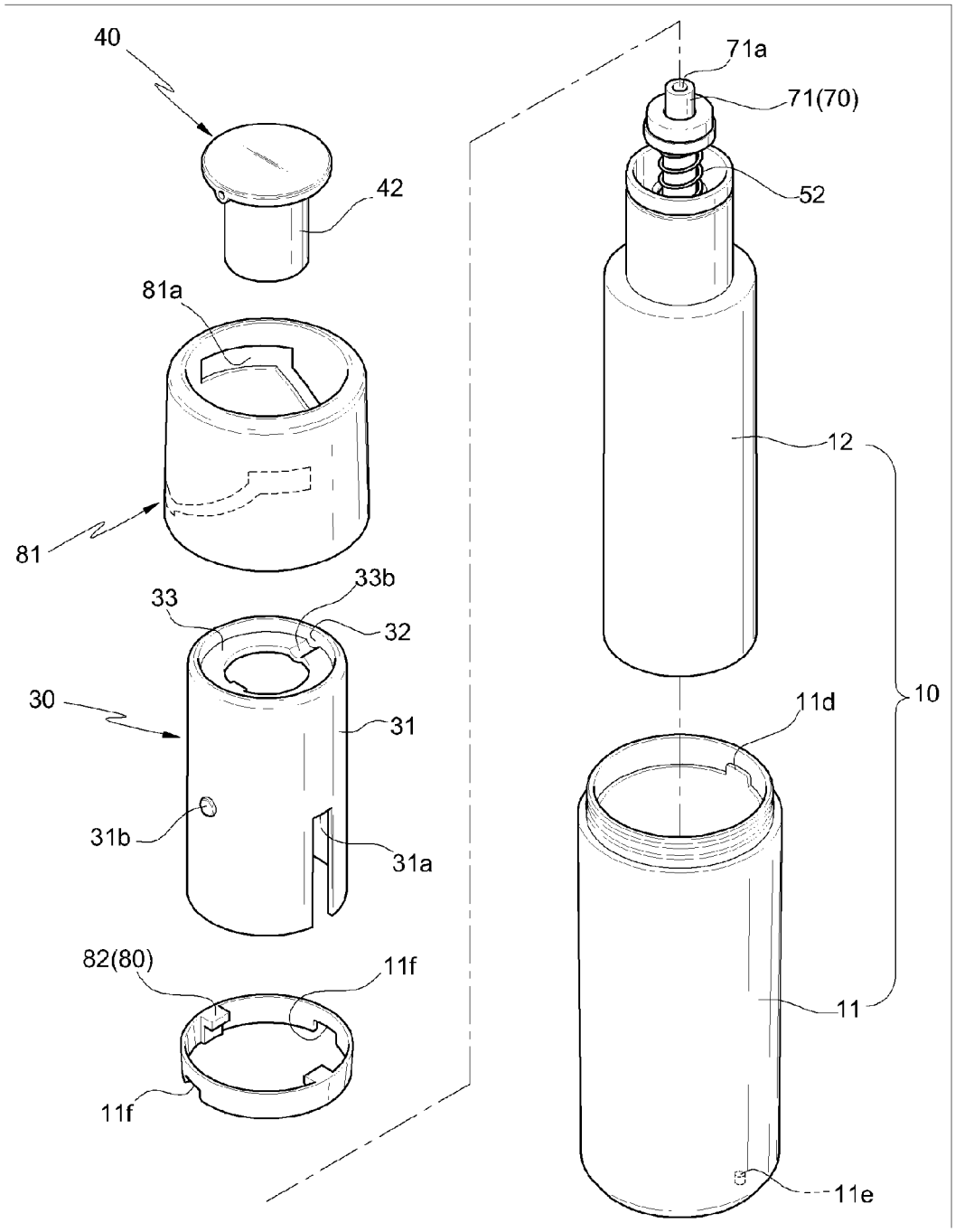
FIGS. 1 and 2 are exploded perspective views illustrating a cosmetic receptacle according to an embodiment of the present invention.
Figure 2:
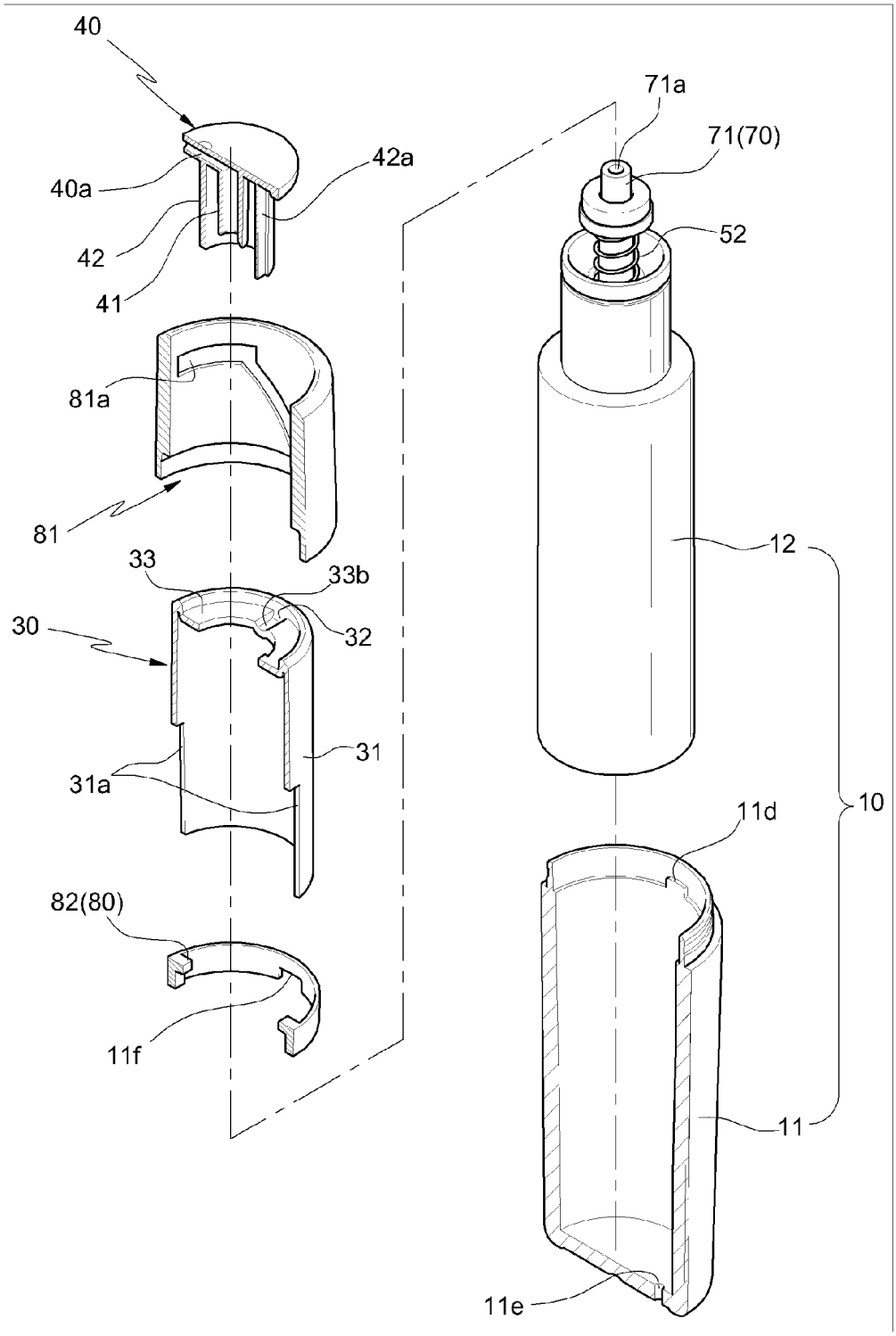
Figure 3:
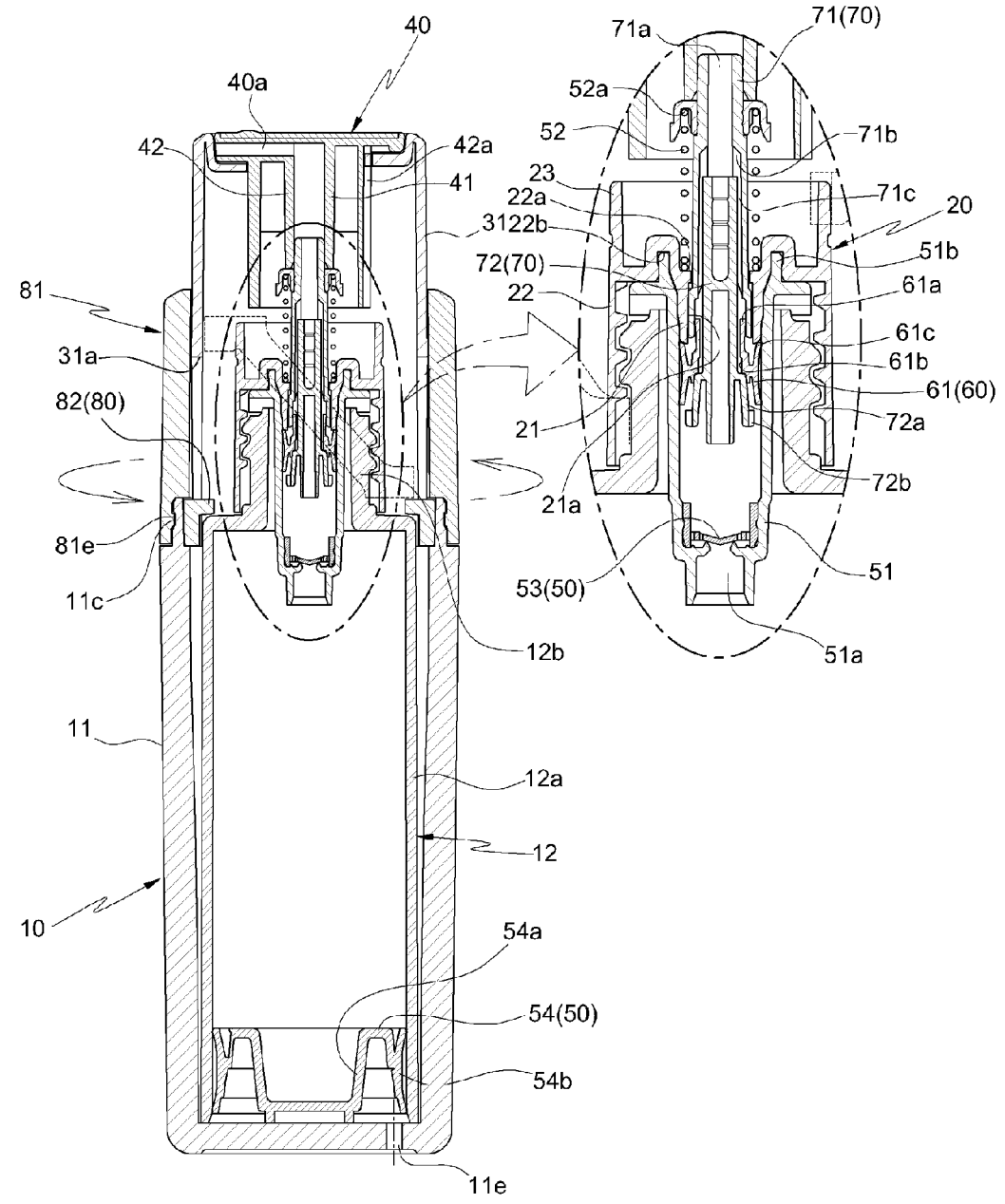
FIG. 3 is a sectional view illustrating a cosmetic receptacle according to an embodiment of the present invention.
Figure 4:
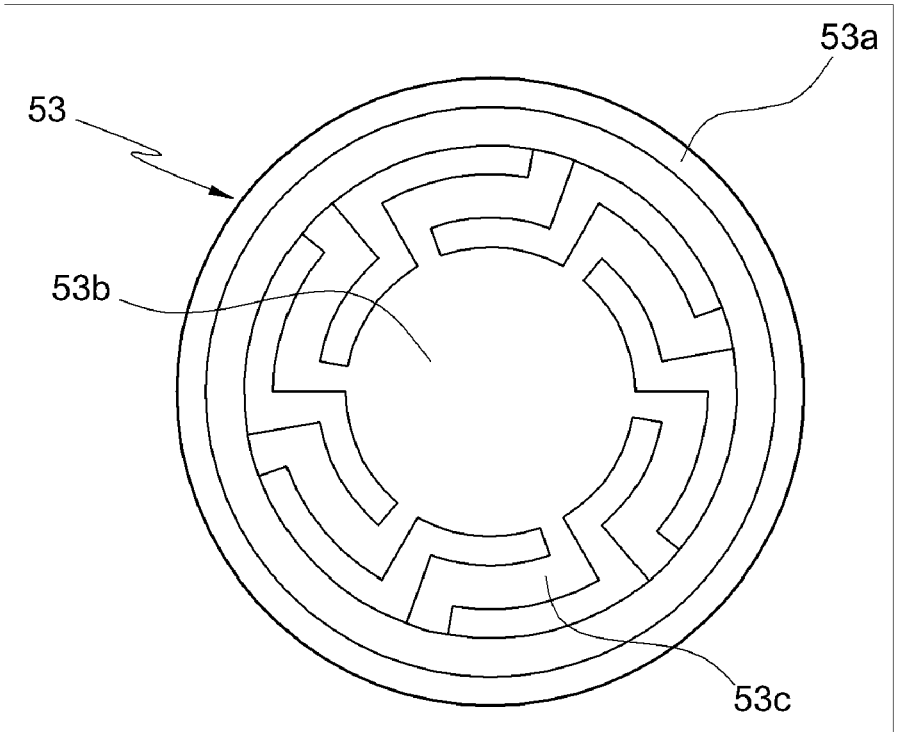
FIG. 4 is a plan view illustrating a valve body shown in FIG. 3.

FIGS. 1 and 2 are exploded perspective views illustrating a cosmetic receptacle according to an embodiment of the present invention, FIG. 3 is a sectional view illustrating a cosmetic receptacle according to an embodiment of the present invention, and FIG. 4 is a plan view illustrating a valve body shown in FIG. 3.

As shown in these drawings, the cosmetic receptacle according to the embodiment of the present invention includes: a receptacle part 10 including an outer receptacle 11 and an inner receptacle 12 assembled with the interior of the outer receptacle 11; an inner cap 20 assembled with an upper end of the inner receptacle 12; a shoulder part 30 assembled with an upper end of the outer receptacle 11; a button 40 installed at the upper side of the inner cap 20; a pumping part 150 allowing liquid cosmetics kept into the inner receptacle 12 to be squeezed out when the user pushes a button 40; and a button locking part 80 moving a shoulder part 30 respective to the button 40 so as to hold pushing operation of the button 40 when the user pushes it.

The outer receptacle 11 includes an outer receptacle body part 11*a* having a cylinder-shape and a locking ring 11*b* assembled with an inner surface of an upper end of the outer receptacle body part 11*a*.

The outer receptacle body part 11*a* has an opening part formed at an upper surface thereof and a rotating guide groove 11*c* formed at a surface thereof along a circumferential direction.

Also, the outer receptacle body part 11*a* has fixing protruding parts 11*d* formed at the inner surface of the upper end of the outer receptacle body part 11*a* and a ventilating hole lie formed at the bottom surface thereof.

The locking ring 11*b* has fixing grooves 11*f*, which are formed at the lower part thereof so as to correspond to the fixing protruding parts 11*d*, and is assembled with the outer receptacle body part 11*a* in such a manner that each fixing protruding part 11*d* is inserted into each fixing groove 11*f*.

Accordingly, the locking ring 11*b* can rotate together with the outer receptacle body part 11*a*.

The inner receptacle 12 includes an inner receptacle body part 12*a* having a pipe-shape and a neck part 12*b* formed at the upper end of the inner receptacle body part 12*a*.

The inner receptacle 12 having such a structure is assembled with the interior of the outer receptacle 11 in such a manner that an upper surface opening part of the inner receptacle 12 is arranged in the same direction as an upper surface opening part of the outer receptacle 11.

The inner cap 20 includes a supporting pipe part 21, a cap skirt part 22 extending from an upper end of the supporting pipe part 21 so as to surround the supporting pipe part 21, and an elevation guide pipe 23 extending vertically from the cap skirt part 22.

The supporting pipe part 21 has a communicating hole 21*a* formed through an entire length thereof.

The cap skirt part 22 has a spring supporting jaw 22*a* formed at a contact area of the supporting pipe part 21, and has a cylinder fixing groove 22*b*, which is opened toward the inner receptacle 12, formed at an outer side of the spring supporting jaw 22*a*.

The inner cap 20 having such a structure is assembled with an outer surface of the neck part 12*b* by a screw through an inner surface of the cap skirt part 22 in a state where the supporting pipe part 21 enters the interior of the neck part 12*b*.

Accordingly, the communicating hole 21*a* communicates with the inner space of the inner receptacle 12, the upper surface opening part of the inner receptacle 12 is closed by the inner cap 20, and the inner cap 20 can move together with the inner receptacle 12.

The shoulder part 30 includes a shoulder body part 31 having a pipe-shape, a channel closing wall part 32 bent from an upper end of the shoulder body part 31 to a lower direction, and a seating flange 33 bent from the channel closing wall part 32 toward the center of the shoulder body part 31.

The shoulder body part 31 has a pair of stopper grooves 31*a* of a recessed shape formed from the lower end of the shoulder body part 31 along a longitudinal direction of the shoulder body part 31 and a pair of elevation leading protuberances 31*b* formed at an outer surface of the shoulder body part 31.

The channel closing wall part 32 is formed so as to close a side surface opening end of a discharging channel 40*a* when each elevation leading protuberance 31*b* is inserted into a lock keeping groove 81*b* which will be described below.

A mounting hole 33*a* is formed at the inner side of the seating flange 33.

Also, the seating flange 33 has a seating groove 33*b* formed at an upper surface thereof, and an elevation guide rib 33*c* protrudes from an area facing the seating groove 33*b* so as to enter the elevation guide rib 33*c*

In the shoulder part 30 having such a structure, stopper protuberances 82, which will be described below, are inserted into the stopper groove 31*a* in a state where the mounting hole 33*a* is arranged at an upper side of the communicating hole 21*a*, and each elevation leading protuberance 31*b* is installed so as to be inserted into each locking operation groove 81*a* will be described below.

The button 40 has a discharging channel 40*a*, which is opened through a side surface and a lower surface thereof, formed at the interior of the button 40.

Also, the button 40 has a shaft fixing groove part 41 extending from a lower surface thereof along a longitudinal direction of the outer receptacle 11, and an elevation operating pipe 42 is formed at a periphery area of the shaft fixing groove part 41.

An elevating operation groove 43 is formed at an area facing the elevation guide rib 33*c* of the outer surface of the elevation operating pipe 42, along a longitudinal direction thereof.

The button 40 having such a structure is installed in such a manner that an upper end of the guide shaft 71 is fixedly inserted into the shaft fixing groove part 41 in a state where the elevation operating pipe 42 is arranged at the inner side of the elevation guide pipe 23.

Accordingly, the button 40 can approach and move away from the inner cap 20 while being interlocked with the guide shaft 71 performing an elevation movement in a state where the lower surface opening end of the discharging channel 40*a* is positioned toward the communicating hole 21*a*.

The pumping part 50 includes: a cylinder 51 assembled with the shoulder part 30; a return spring 52 interposed between the inner cap 20 and the shoulder part 30; a guide channel part 60 including a guide channel connecting the discharging channel 40*a* with the inner space of the cylinder 51; a valve body 53 installed at a bottom surface of the cylinder 51; and a receptacle piston 54 installed at the interior of the inner receptacle 12.

The cylinder 51 has an inflow hole 51*a* formed at a lower surface thereof and an opening part formed at an upper surface thereof.

A fixing wall part 51*b* is formed at the cylinder 51 so as to surround the upper surface opening part of the cylinder 51.

The cylinder 51 having such a structure can be assembled with the inner cap 20 by fixedly inserting the fixing wall part 51*b* into the cylinder fixing groove 22*b* in a state where the upper surface opening part communicates with the communicating hole 21*a*.

The return spring 52 has a lower end supported by the spring supporting jaw 22*a* and an upper end supported by a spring cap 52*a*. Herein, the spring cap 52*a* has a ring-shape and makes contact with a lower end of the shaft fixing groove part 41.

Accordingly, the return spring 52 can accumulate elastic force when the button 40 moves toward the inner cap 20.

The guide channel part 60 includes a guide pipe 70 installed so as to enter the interior space of the cylinder 51, and a cylinder piston 61 installed at the interior of the cylinder 51.

The guide pipe 70 includes a guide shaft 71 having a shaft hole 71*a* formed thereon and a guide stem 72 installed in such a manner that an upper end is inserted into the shaft hole 71*a*.

The shaft hole 71*a* is formed through an entire length of the guide shaft 71.

A stem supporting jaw 71*b* is formed at an inner circumferential surface of the shaft hole 71*a*, and shaft guide protruding parts 71*c* are distributed along a circumferential direction of the shaft hole 71*a* at an upper side of the stem supporting jaw 71*b* of the inner circumferential surface.

Each shaft guide protruding part 71*c* allows a gap creating a channel to be formed between an outer surface of the guide stem 72 and an inner surface of the shaft hole 71*a*.

The guide shaft 71 having such a structure passes through the communicating hole 21*a*, and is installed in such a manner that a lower end enters the inner space of the cylinder 51.

The guide stem 72 has a stem skirt part 72*a* formed at a lower area thereof, and stem guide protruding parts 72*b* are distributed along a circumferential direction of the stem skirt part 72*a* at an outer surface of the stem skirt part 72*a*.

The guide stem 72 having such a structure is inserted into the shaft hole 71*a* in such a manner that an upper end makes contact with the stem supporting jaw 71*b*, and a lower part passes through a passing hole 61*c* which will be described below.

As such, in a state where the guide pipe 70 is installed, a guide channel is formed in an area between the stem guide protruding parts 72*b*, in an area between the inner circumferential surface of the passing hole 61*c* and the outer surface of the guide stem 72, in an area between the outer surface of the guide stem 72 and the inner circumferential surface of the shaft hole 71*a*, in an area between shaft guide protruding parts 71*c*, and in the upper area of the shaft hole 71*a*. Accordingly, an upper exposed end of the guide channel (the upper and lower ends of the shaft hole are exposed) communicates with the discharging channel 40*a*, and a lower exposed end of the guide channel communicates with the inner space of the cylinder 51.

The cylinder piston 61 includes a cylinder piston body part 61*a* and a cylinder closing pipe 61*b* extending from the entire periphery of the lower end of the cylinder piston body part 61*a* outward the exterior.

The cylinder piston body part 61*a* has a center area at which a passing hole 61*c* is formed.

The cylinder piston 61 having such a structure is installed at the interior of the cylinder 51 in such a manner that the cylinder closing pipe 61*b* makes close contact with the inner surface of the cylinder 51, and the inner circumferential surface of the passing hole 61*c* makes contact with the stem cut part 72*a*.

The valve body 53 includes a peripheral wall part 53*a* having a pipe-shape, an opening/closing pipe 53*b* arranged at the interior of the peripheral wall part 53*a*, and a plurality of connecting arms 53*c* connecting the opening/closing pipe 53*b* with the peripheral wall part 53*a*.

The valve body 53 having such a structure is installed at the bottom surface of the cylinder 51 in such a manner that the peripheral wall part 53*a* is fixedly inserted into an inner wall of the cylinder 51, and the opening/closing pipe 53*b* closes the inflow hole 51*a*.

The receptacle piston 54 includes a receptacle piston body part 54*a* having a recessed shape and a receptacle closing pipe 54*b* extending from the entire periphery area of the upper end of the receptacle piston 54 outward.

The receptacle piston 54 having such a structure is installed at the interior of the inner receptacle 12 in such a manner that the receptacle closing pipe 54*b* makes close contact with the inner surface of the inner receptacle body part 12*a*.

Accordingly, the receptacle piston 54 closes the lower surface opening part of the inner receptacle 12.

Figure 9:
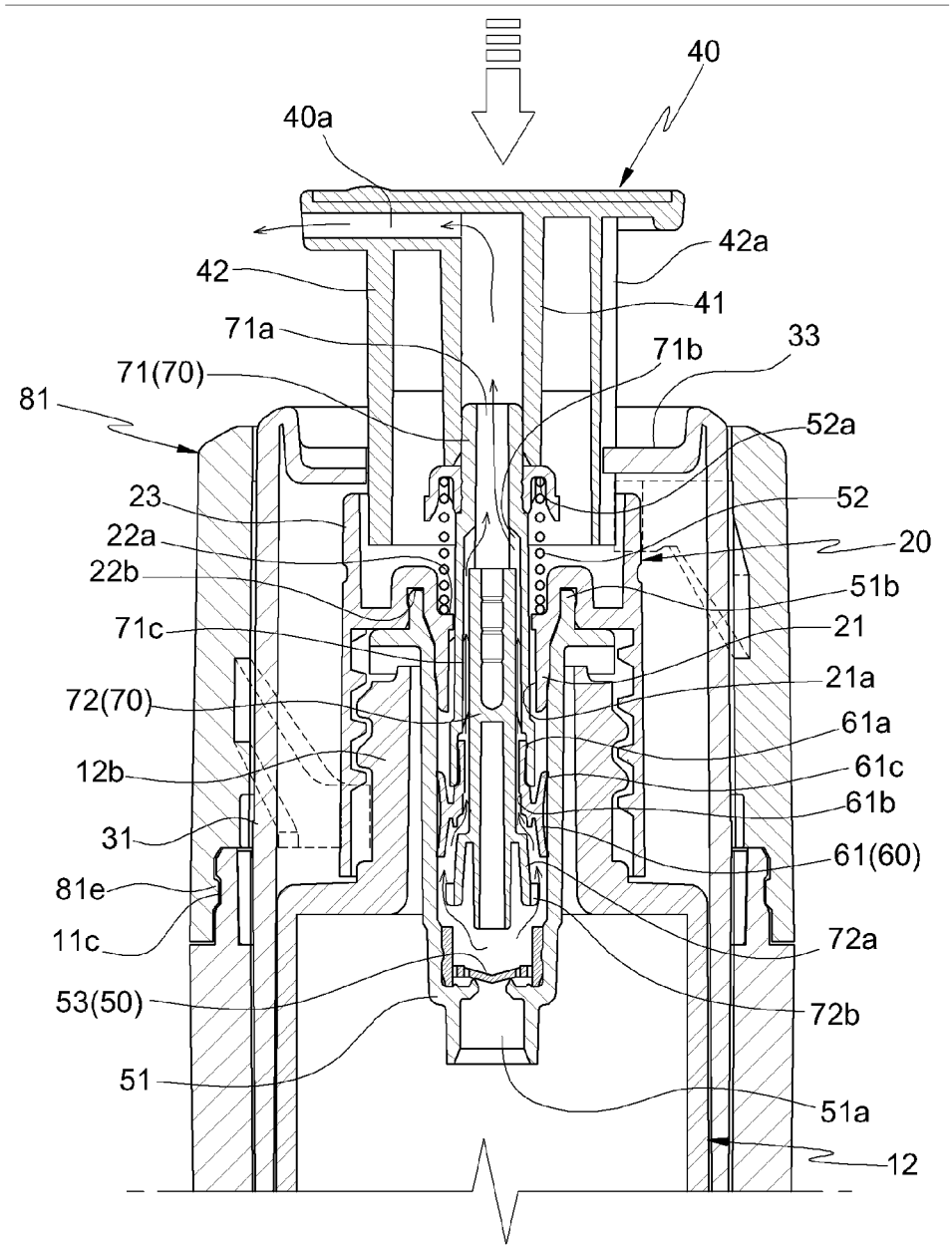
Figure 10:
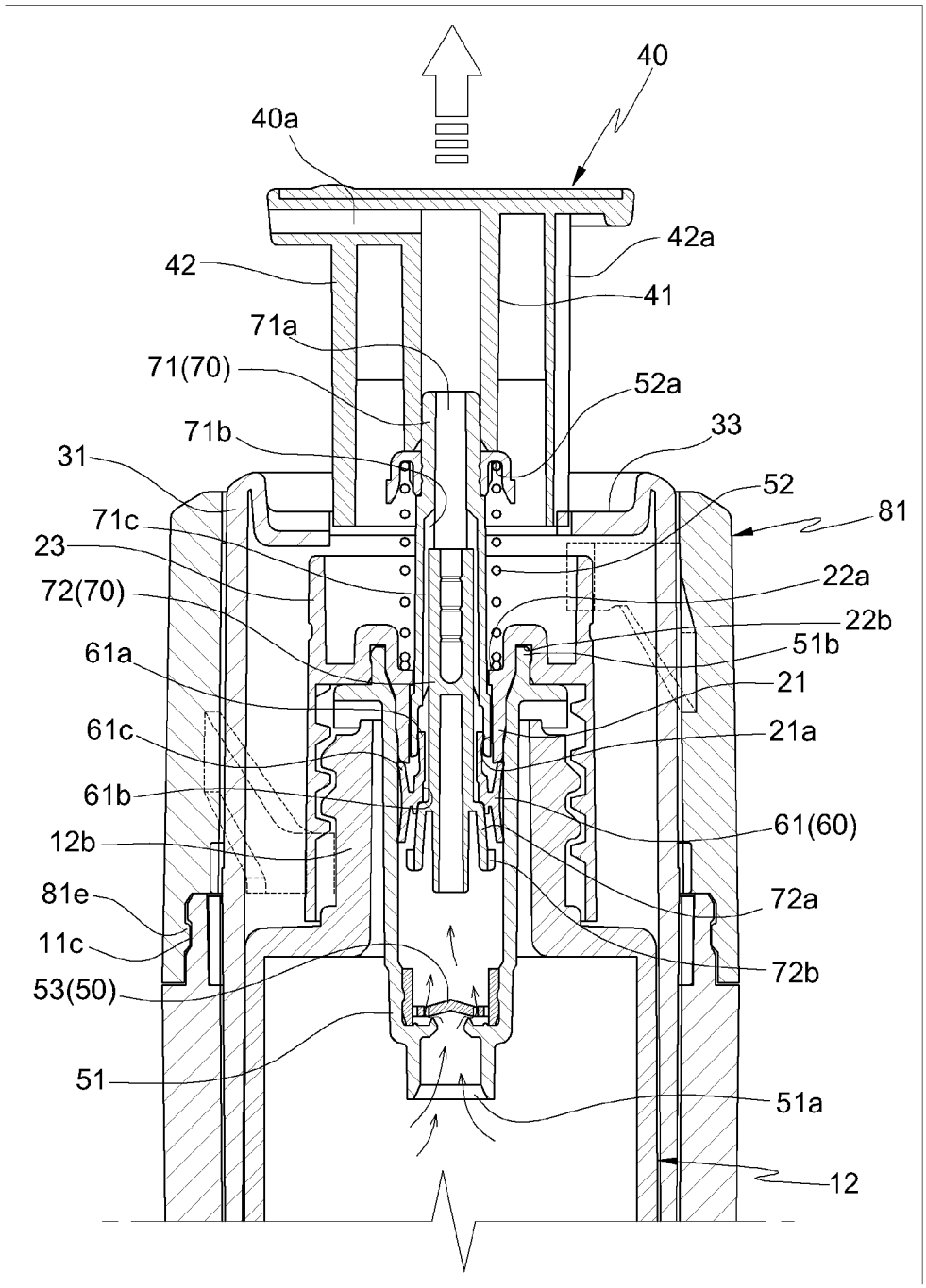
Figure 11:
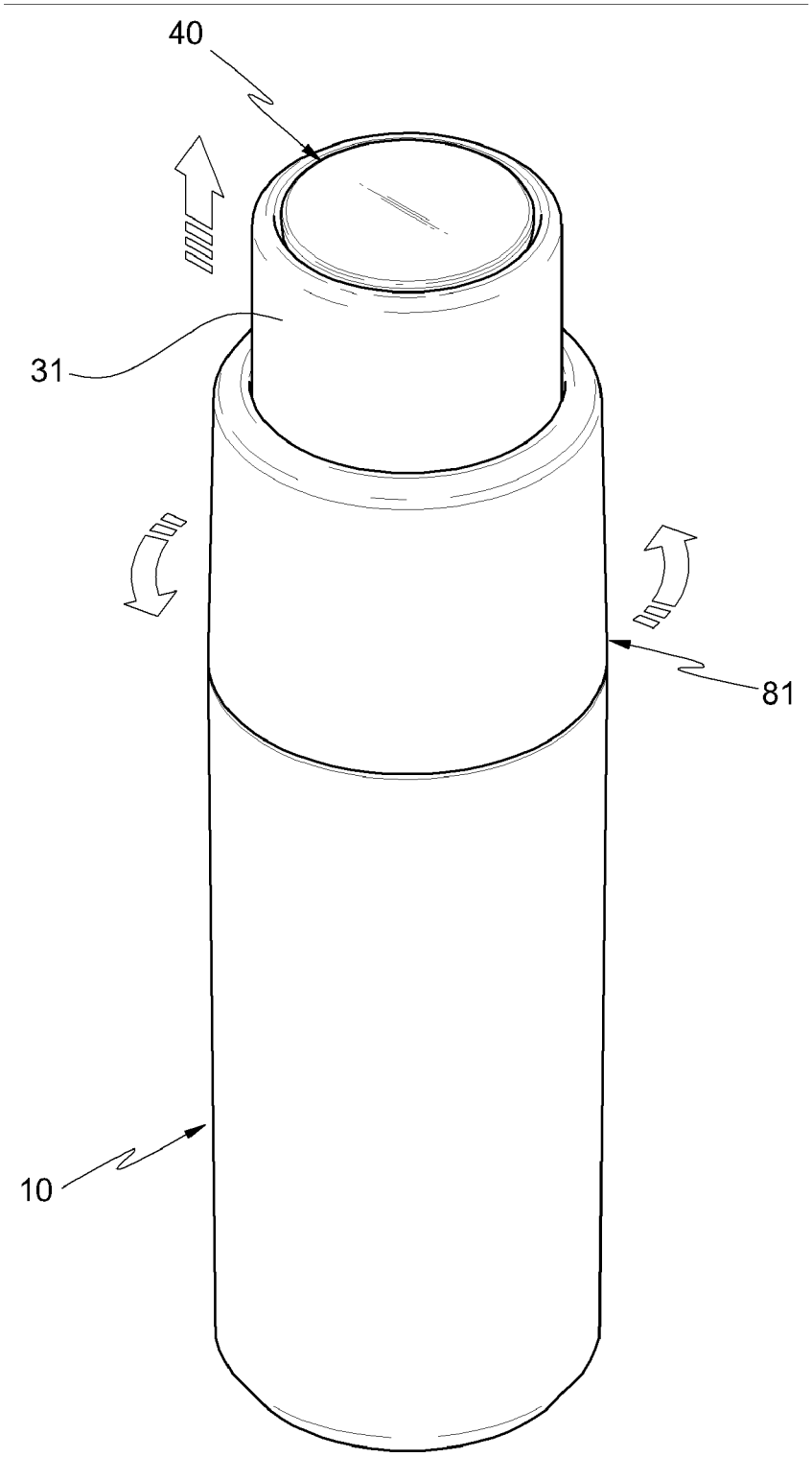

With reference to FIGS. 9 and 10, the operation of the pumping part 50 having such a structure will be described below.

When the button 40 is pressed, the guide shaft 71 and the guide stem 72 are moved downward, and the return spring 52 accumulates elastic force.

When the guide stem 72 moves downward, the inner circumferential surface of the passing hole 61*c* is separated from the outer surface of the guide stem 72 so that the guide channel is opened.

When the guide channel is opened, liquid cosmetics contained within the cylinder 51 is discharged through the guide channel and the discharging channel 40*a* (see FIG. 9).

When virtual pressure respective to the button 40 is released, the button 40, the guide shaft 71, the guide stem 72 return to each initial position by means of elastic force accumulated in the return spring 52.

When the guide stem 72 returns to its initial position, the inner circumferential surface of the passing hole 61*c* makes contact with the outer surface of the guide stem 72 so that the guide channel is closed.

Meanwhile, when the guide stem 72 returns to its initial position, negative pressure is generated in the interior of the cylinder 51.

When negative pressure is generated in the interior of the cylinder 51, suction force is applied in an upper direction so that the inflow hole 51*a* is opened.

When the inflow hole 51*a* is opened, liquid cosmetics kept in the inner receptacle 12 flows into the interior of the cylinder 151.

Meanwhile, when the liquid cosmetics contained within the inner receptacle 12 flow into the interior of the cylinder 51, the receptacle piston 54 moves toward the cylinder 51.

When the button 40 is pressed again, the inflow hole 51*a* is closed by the opening/closing pipe 53*b*, and the liquid cosmetics contained within the cylinder 51 are discharged through the guide channel and the discharging channel 40*a*.

As described above, the guide channel is interlocked with pushing operation of the button 40 performing pushing operation so as to be opened/closed, the bumping part 50 allows liquid cosmetics kept in the inner receptacle 12 to be squeezed out through the discharging channel 40*a* when the button 40 is pushed.

The button locking part 80 includes a locking operation pipe 81 assembled with an outer surface of an upper end of the outer receptacle 11 and stopper protuberances 82 protruding from an inner surface of the locking ring 11*b*.

A pair of locking operation grooves 81*a* is formed at the locking operation pipe 81 while making a phase difference of 180 degrees between them, and a rotation guide protruding part 81*e* is formed at an inner surface of the locking operation pipe 81 so as to correspond to the rotating guide groove 11*c*.

Each locking operation groove 81*a* includes a lock keeping groove 81*b* arranged at an upper area thereof along a horizontal direction, a release keeping groove 81*c* arranged at a lower area thereof along a horizontal direction, and an elevation guide groove 81*d* connecting the lock keeping groove 81*b* with the release keeping groove 81*c* while making a slanted shape.

The locking operation pipe 81 having such a structure is installed in such a manner that the rotation guide protuberance 81*e* enters the rotating guide groove 11*c* in a state where the elevation leading protuberances 31*b* are inserted into the locking operation grooves 81*a*.

Accordingly, the locking operation pipe 81 can rotate respective to the outer receptacle 11.

A method for using the cosmetic receptacle according to an embodiment of the present invention having such a structure will be described below with reference to FIGS. 5 to 14. In order to achieve convenience in describing, it is assumed that liquid cosmetics are contained in a space between the inner receptacle 12 and the receptacle piston 54, and the elevation protuberance 31*b* is located in lock keeping groove 81*b* (see FIG. 8).

Figure 5:
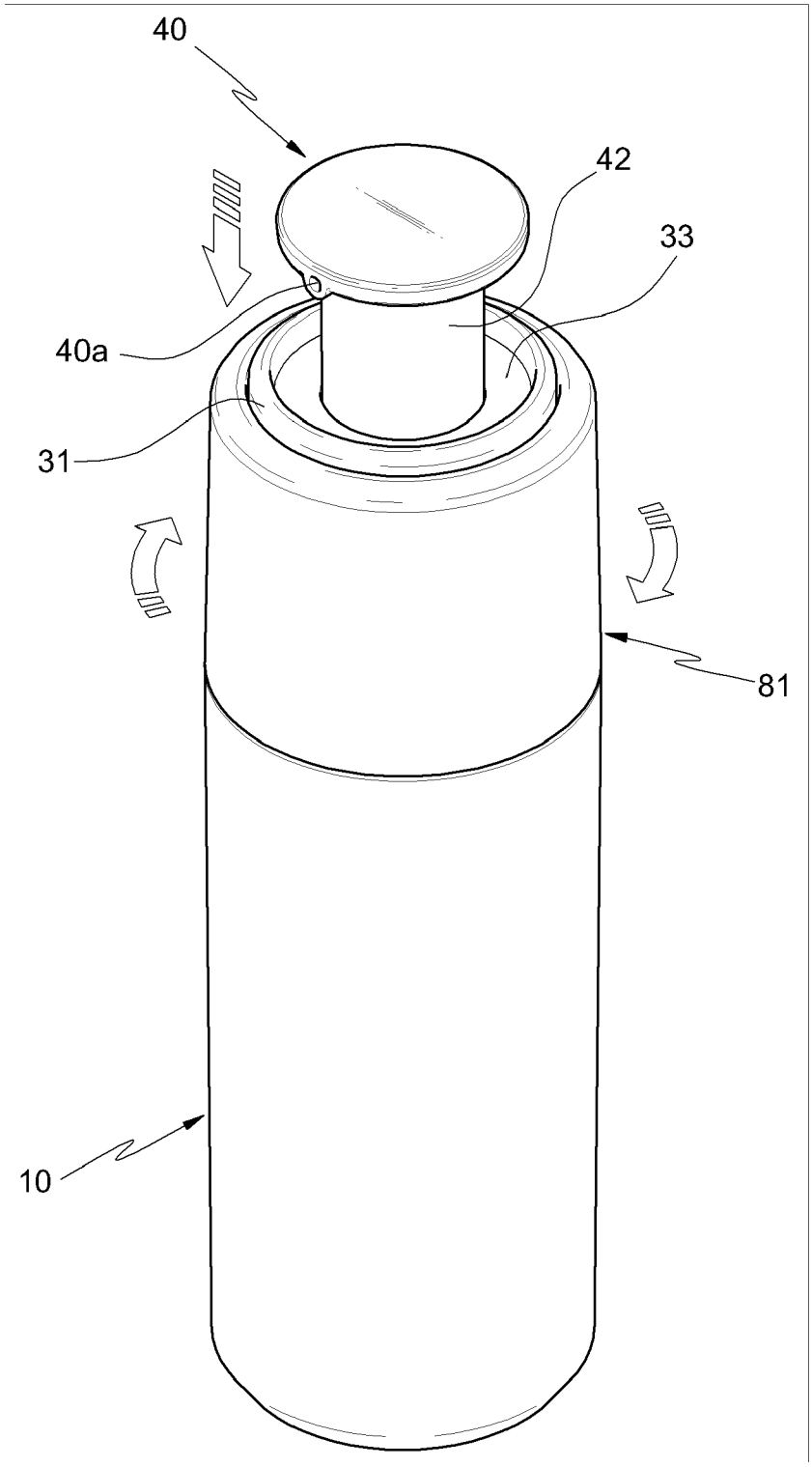
FIGS. 5 to 14 are views illustrating the operation of a cosmetic receptacle according to an embodiment of the present invention, respectively.

Firstly, when the user catches the locking operation pipe 81 and rotates the outer receptacle 11, the shoulder part 30 is rotated by reciprocal operation between each stopper protuberance 82 and each stopper groove 31*a* (see FIG. 5).

Figure 8:
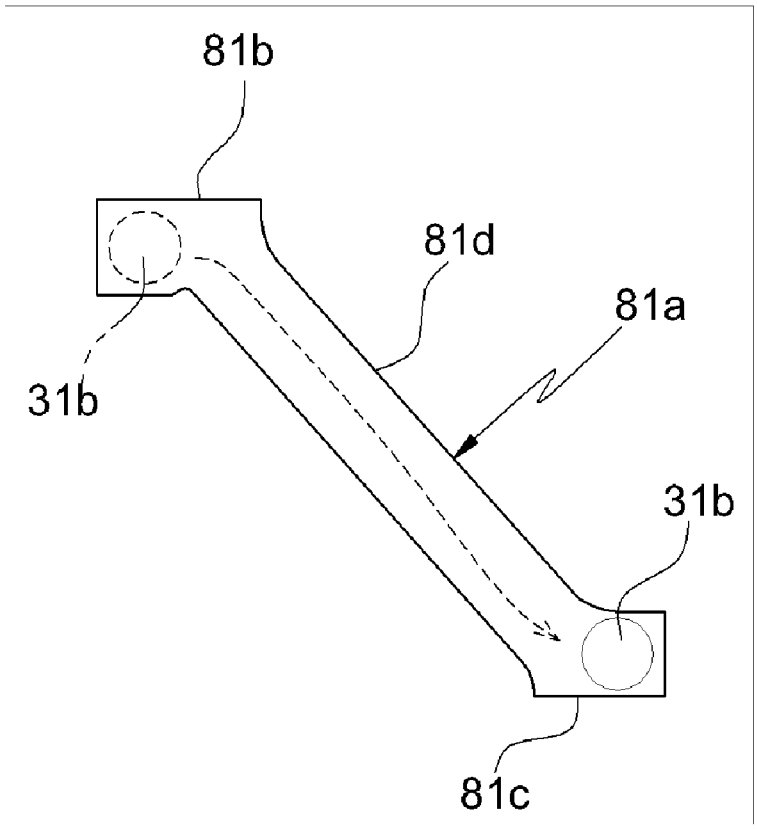

When the shoulder part 30 is rotated, each elevation leading protuberance 31*b* is moved downward from the lock keeping groove 81*b* along the elevation guide groove 81*d* and finally enter the release keeping groove 81*c* (see FIG. 8).

Figure 6:
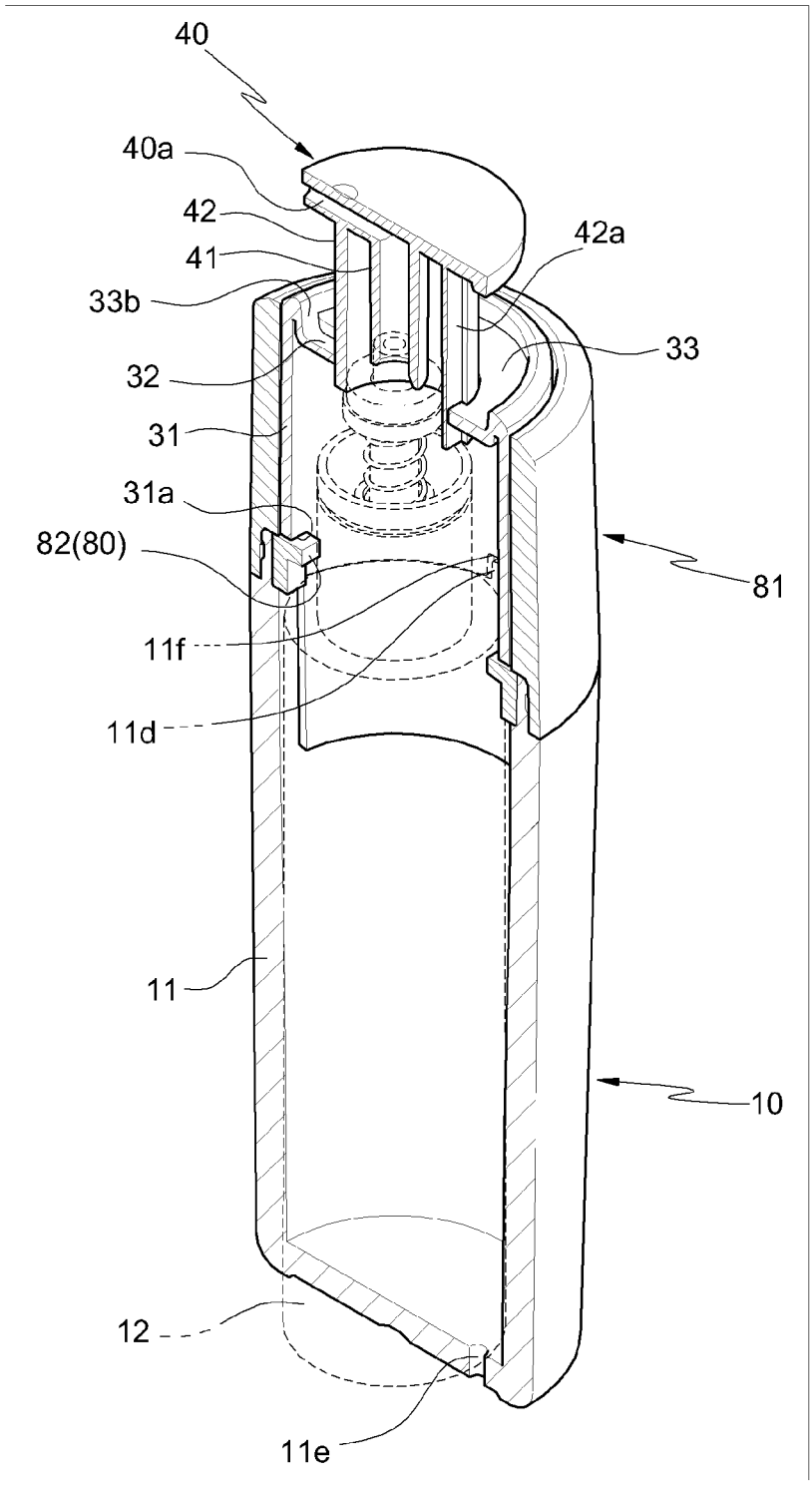
Figure 7:
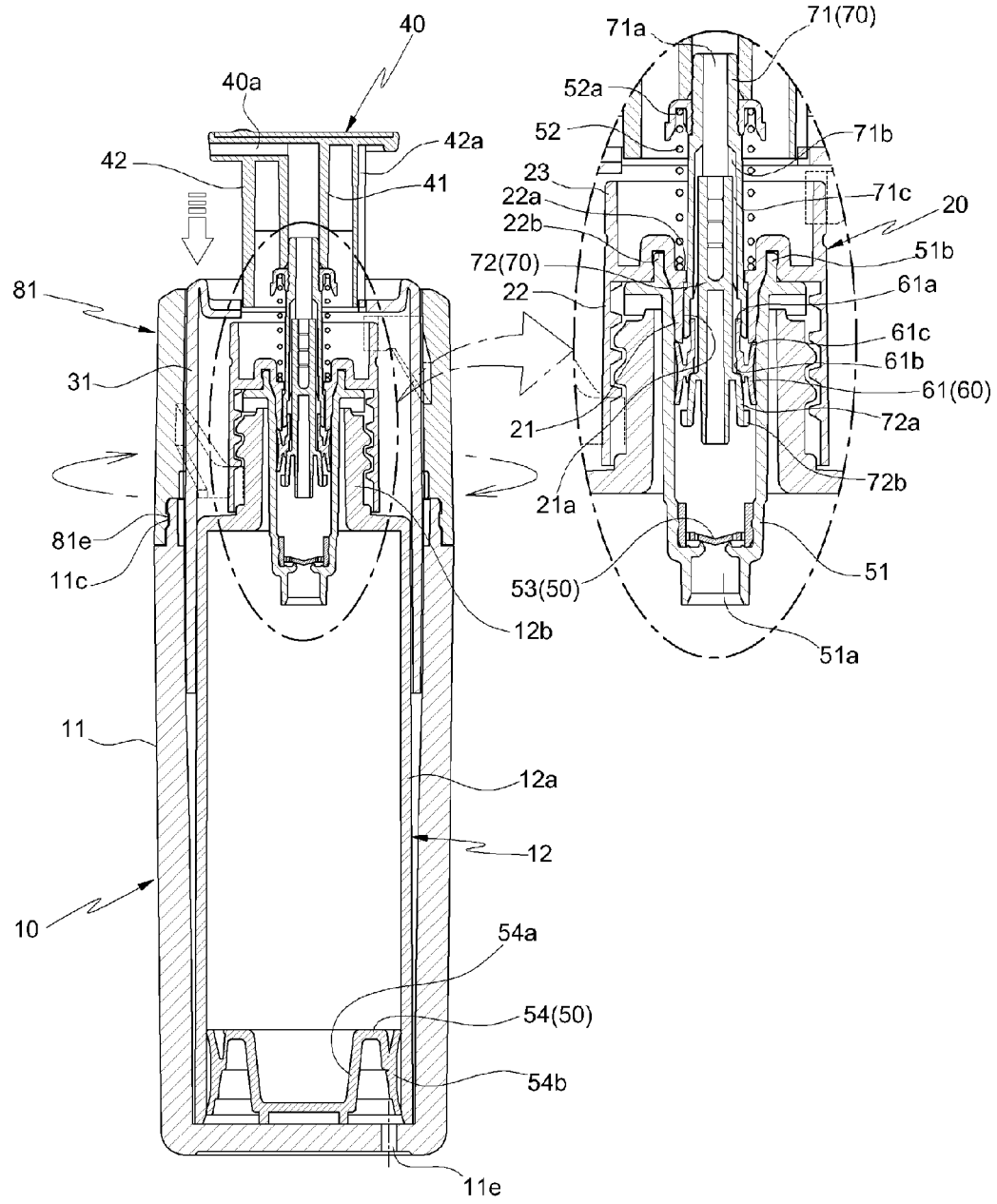

While the elevation leading protuberances 31*b* are moved downward from the lock keeping groove 81*b* and enter the release keeping groove 81*c*, the shoulder part 30 is elevated down (see FIGS. 6 and 7).

In a state where the shoulder part 30 is moved downward, liquid cosmetics kept within the inner receptacle 12 are discharged by performing the operation of pressing the button 40 and releasing the pressure as described above.

When the user again catches the locking operation pipe 81 and rotates the outer receptacle 11 in an opposite direction when the user does not want to use cosmetic, the shoulder part 30 is rotated in the opposite direction by reciprocal operation between the stopper protuberance 82 and the stopper groove 31*a*.

Figure 14:
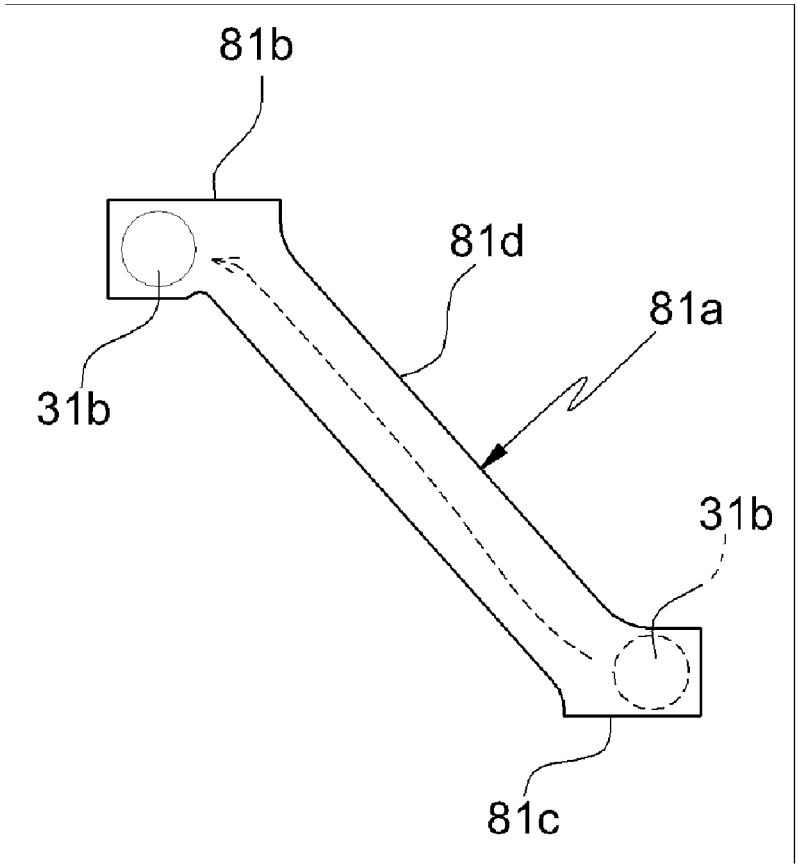
Figure 15:
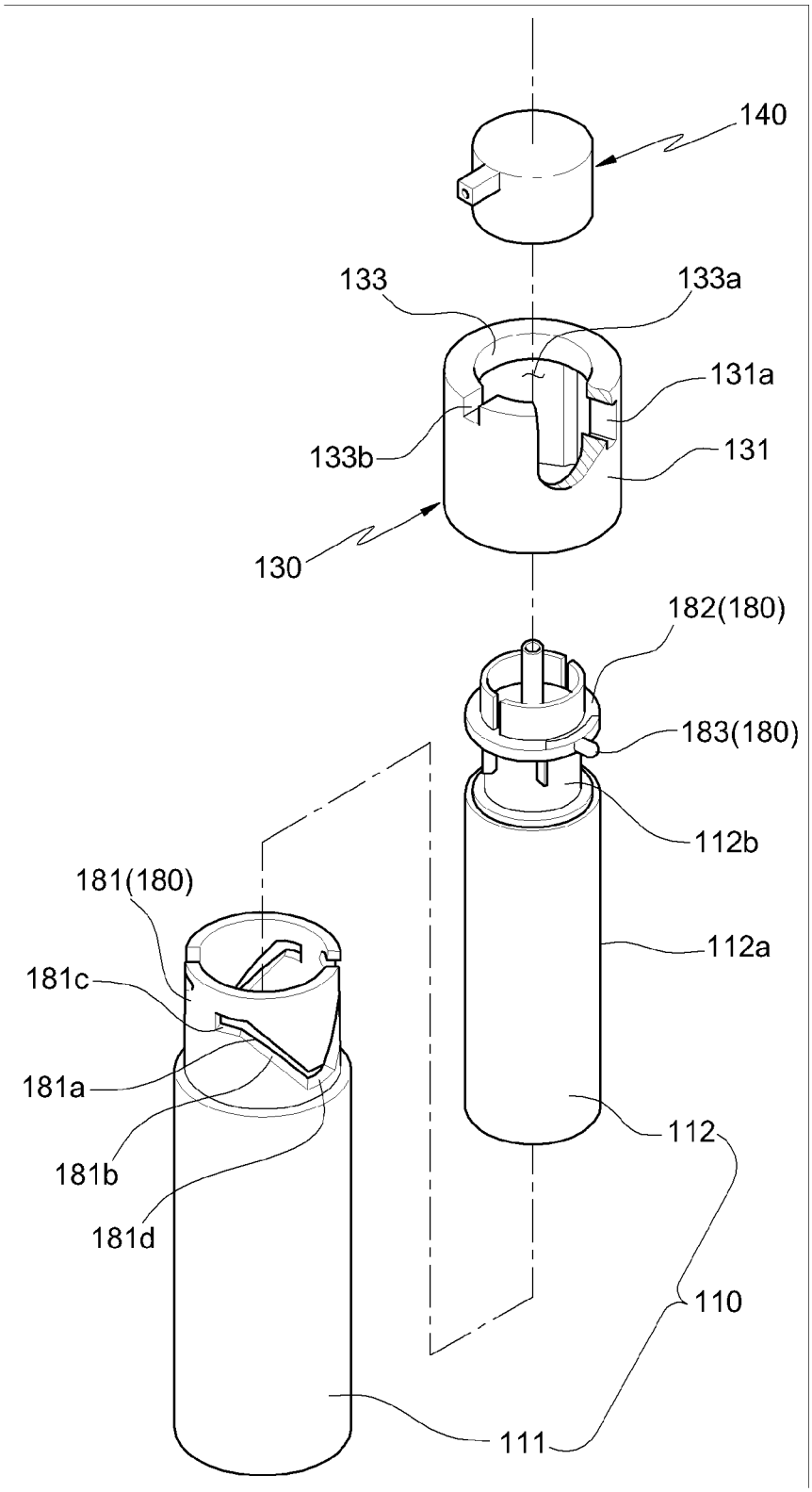
FIG. 15 PRIOR ART
FIG. 15 is an exploded perspective view illustrating a conventional cosmetic receptacle.
Figure 16:
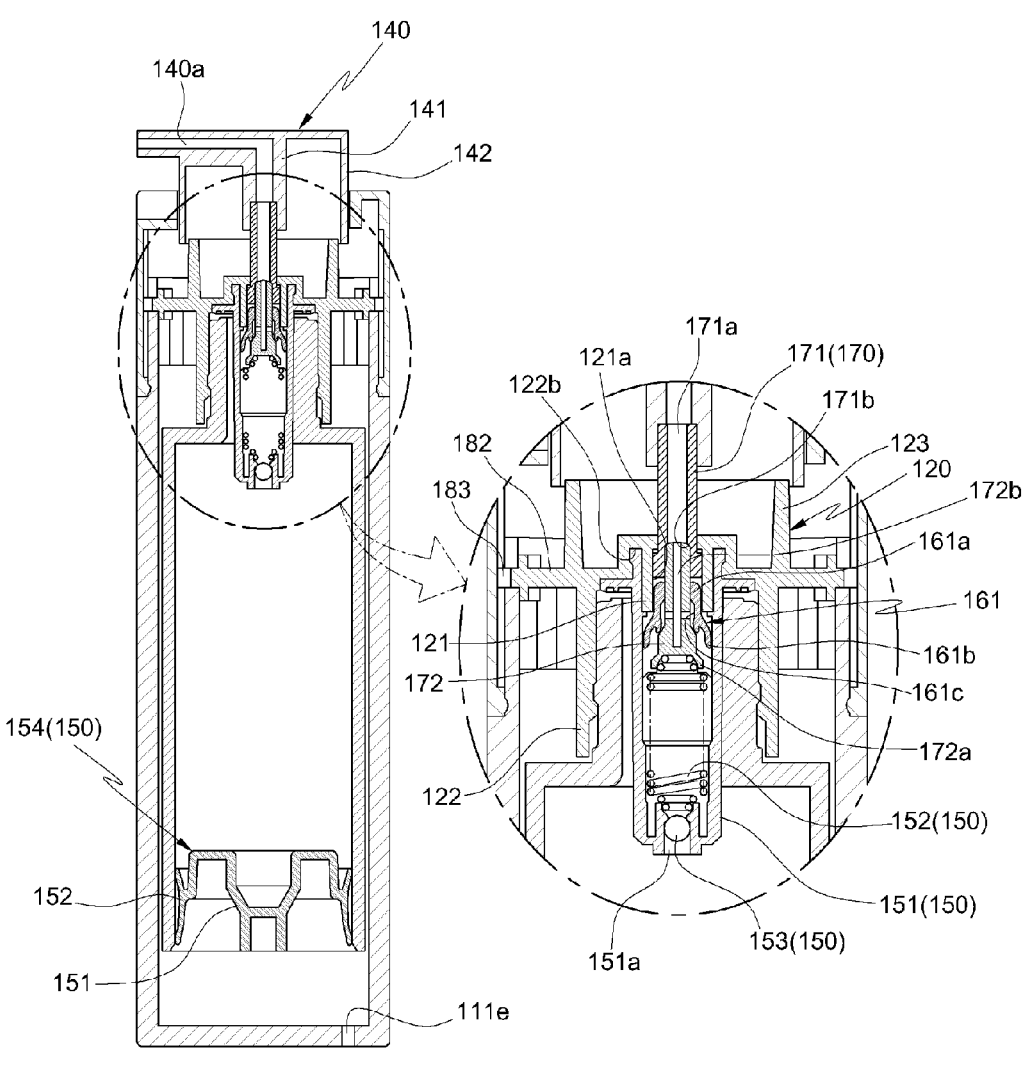
FIG. 16 PRIOR ART
FIG. 16 is a sectional view illustrating a conventional cosmetic receptacle which is assembled.
Figure 17:
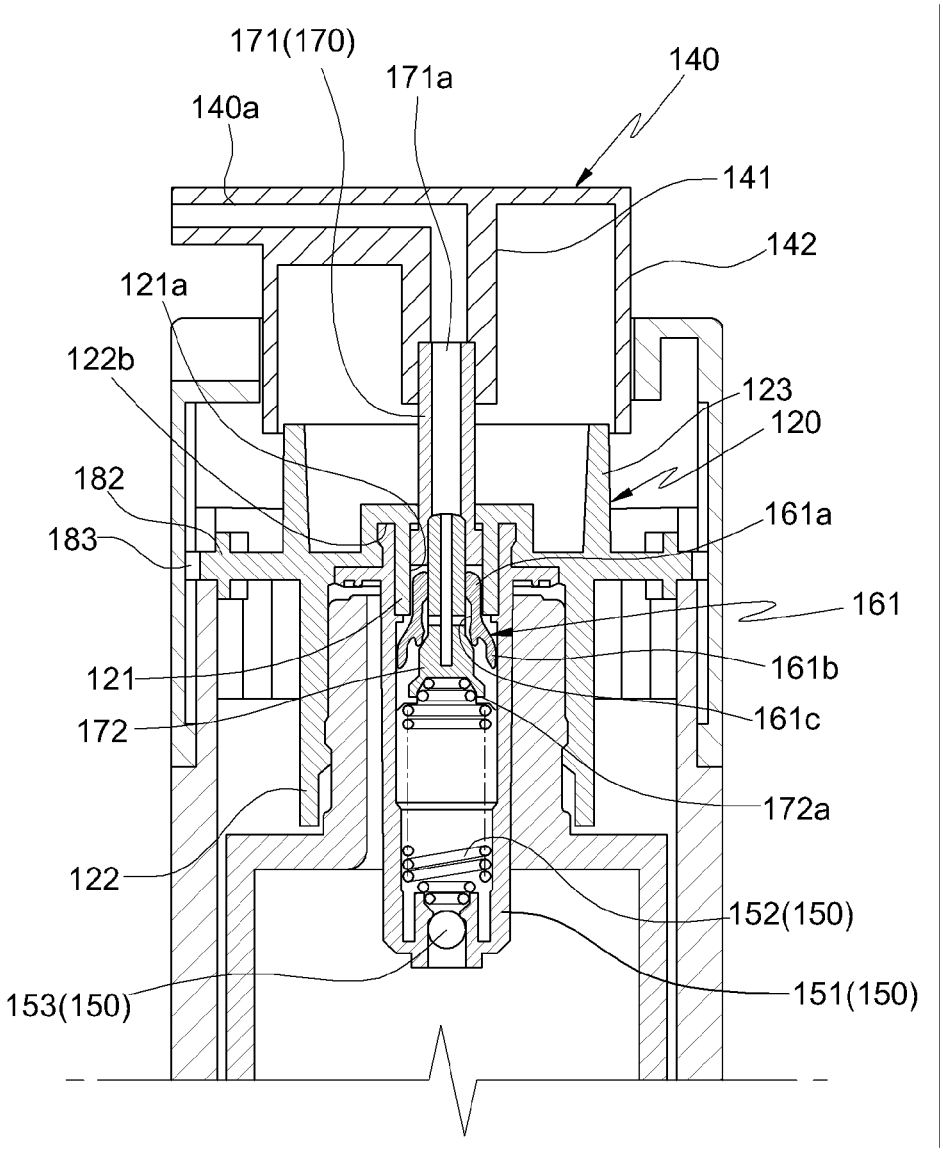
FIG. 17 PRIOR ART
FIGS. 17, 18, 19, and 20 are views illustrating the operation of a conventional cosmetic receptacle, respectively.
Figure 18:
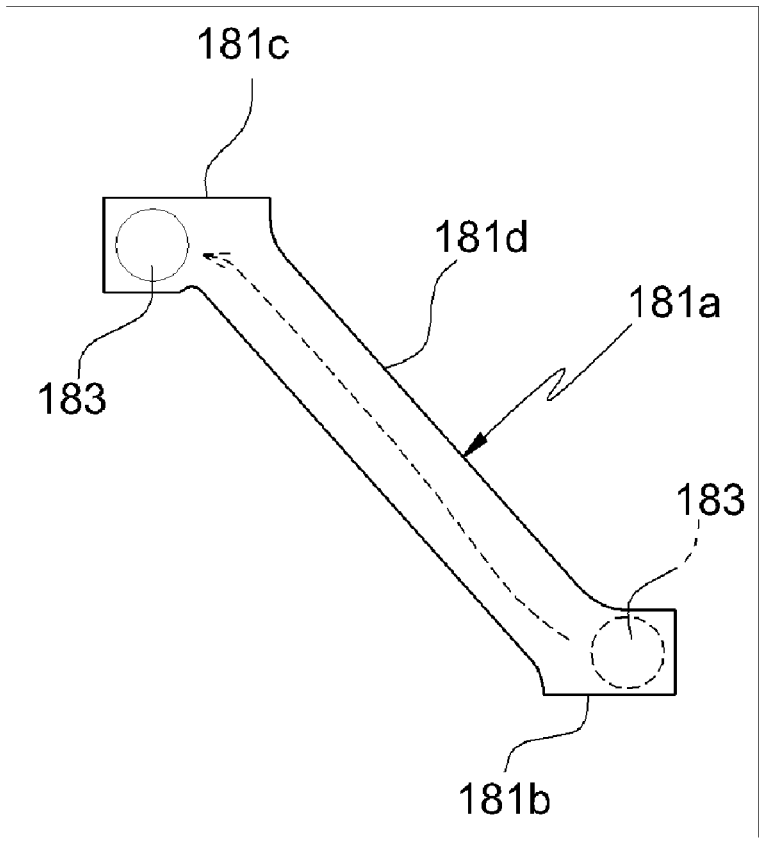
FIG. 18 PRIOR ART
Figure 19:
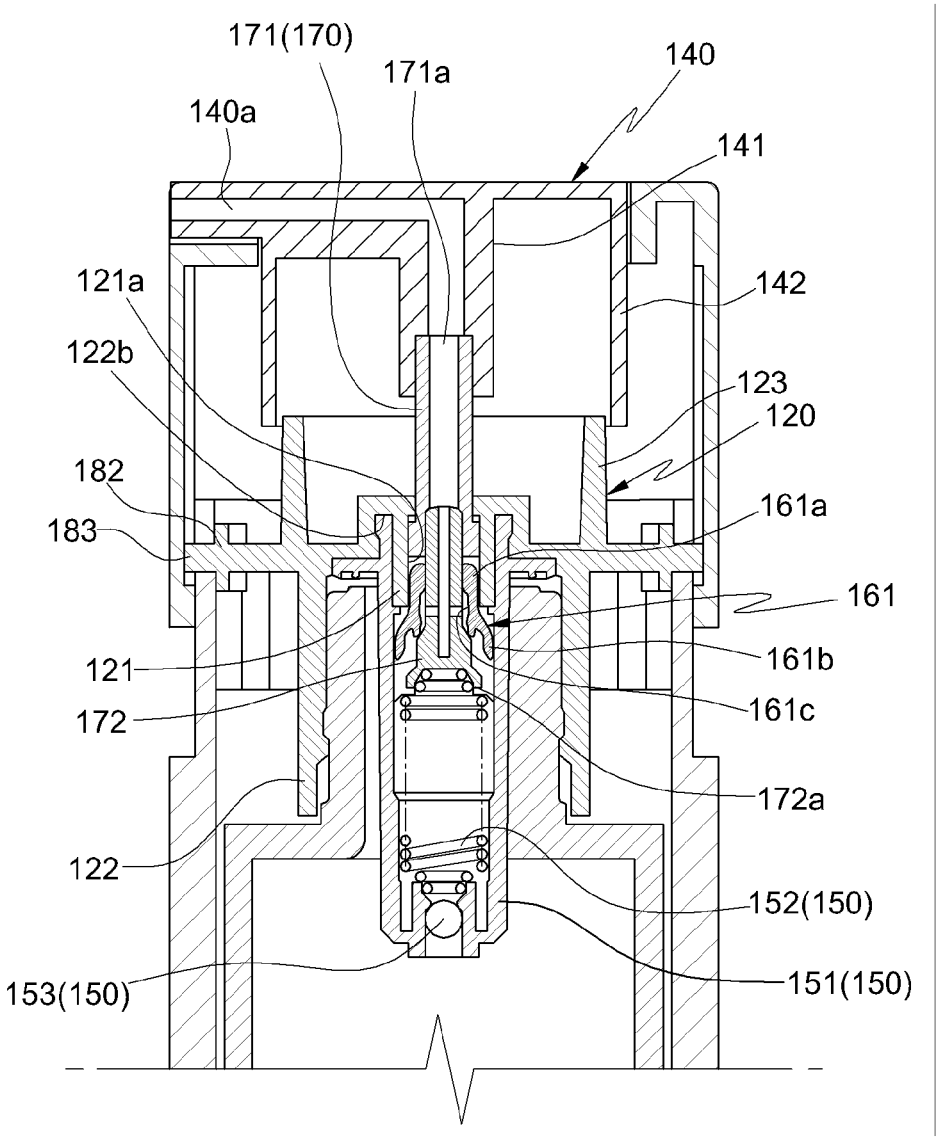
FIG. 19 PRIOR ART
Figure 20:
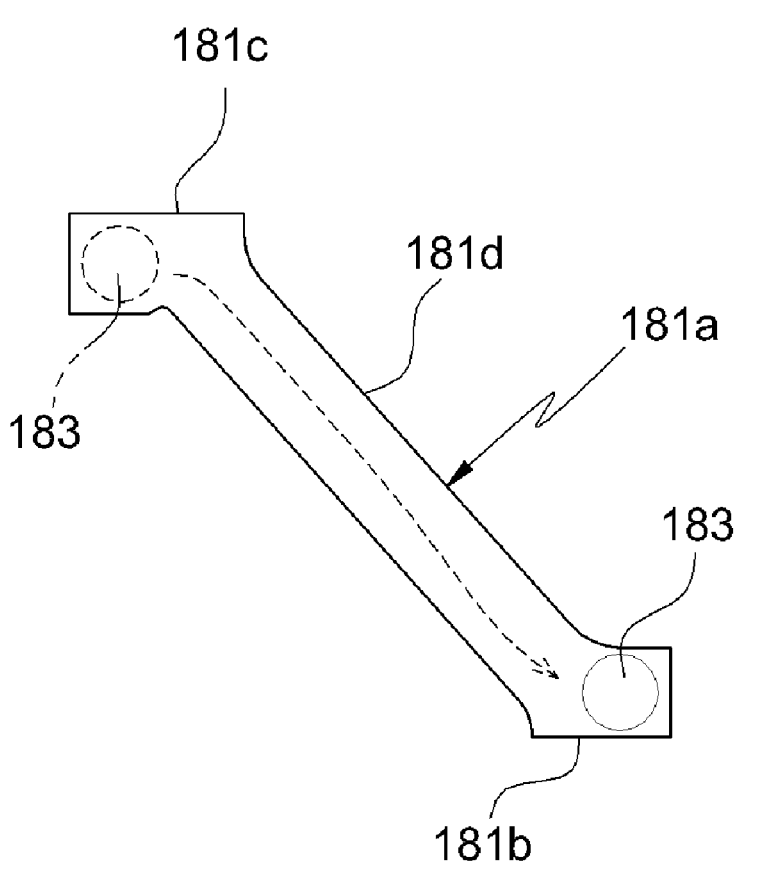
FIG. 20 PRIOR ART

When the shoulder part 30 is rotated in the opposite direction, each elevation leading protuberance 31*b* is moved downward from the release keeping groove 81*c* along the elevation guide groove 81*d* so as to finally enter the lock keeping groove 81*b* (see FIG. 14).

Figure 12:
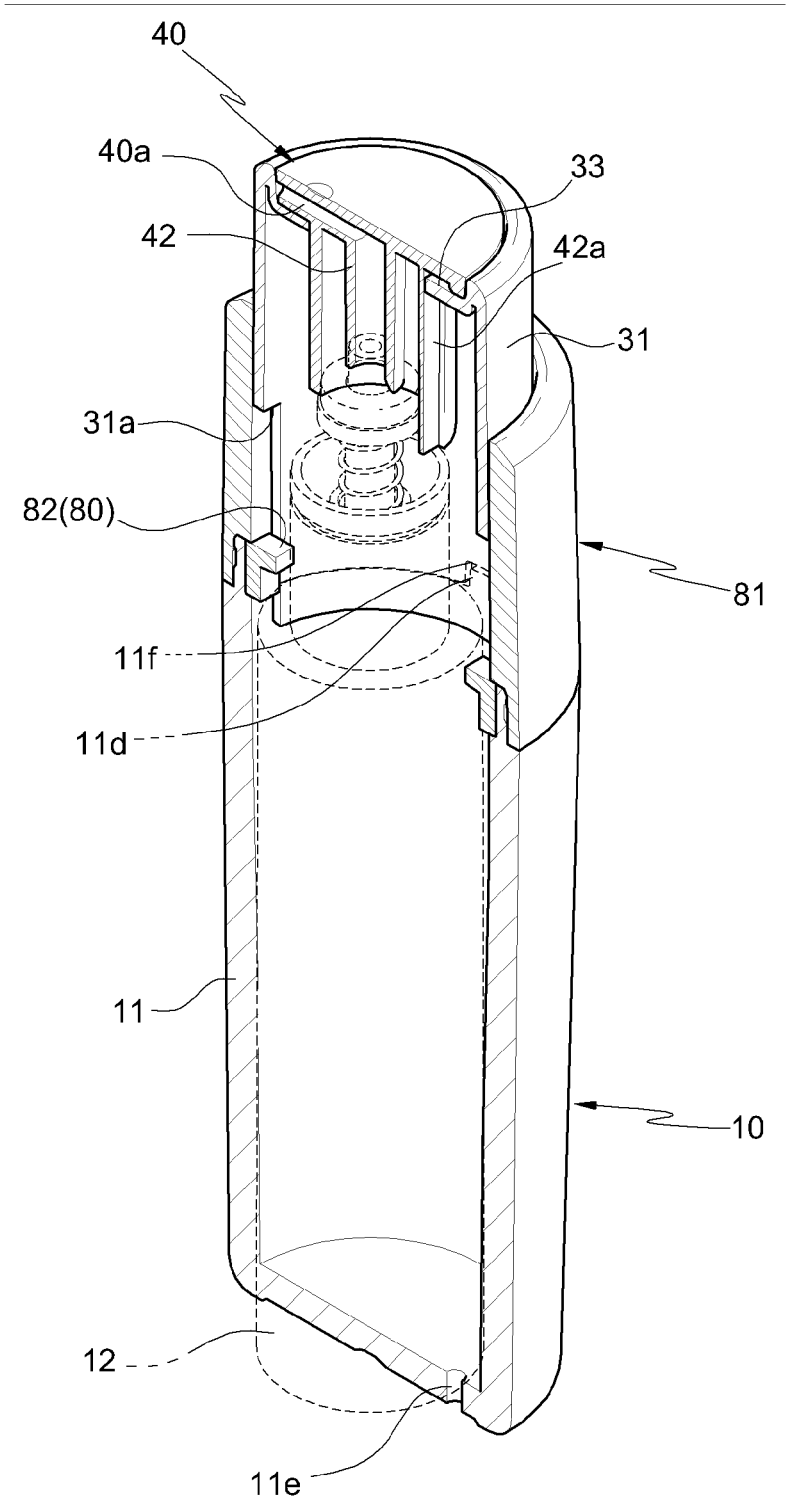
Figure 13:
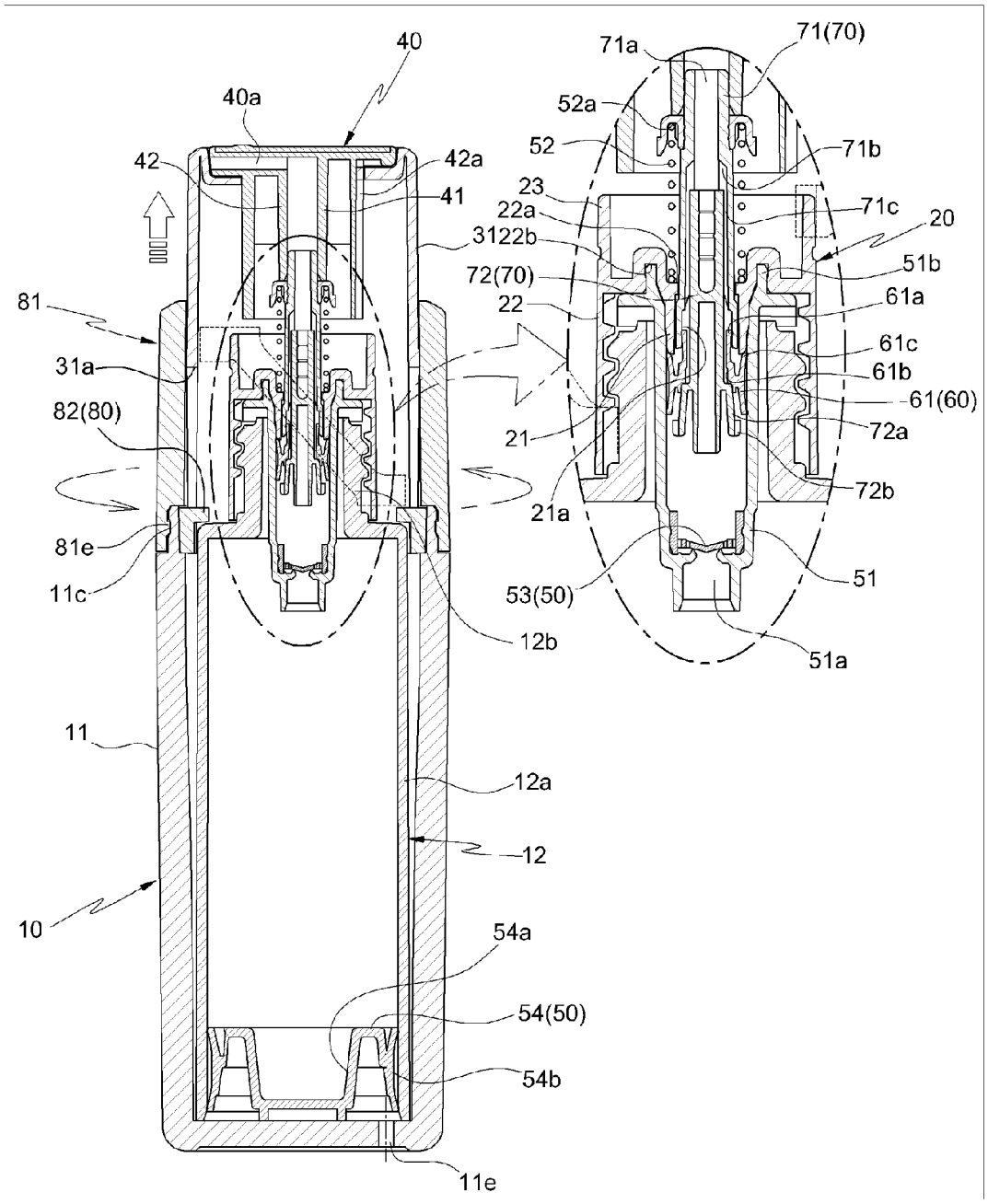

While each elevation leading protuberance 31*b* is elevated from the release keeping groove 81*c* and enters the lock keeping groove 81*b*, the shoulder part 30 is elevated (see FIGS. 12 and 13).

In a state where the shoulder part 30 is elevated, the button 40 makes contact with the seating flange 33, and the discharging channel 40*a* is closed by the channel closing wall part 32.

Also, in a state where the shoulder part 30 has been elevated, the pressing operation of the button 40 can not be performed.

As described above, according to an embodiment of the present invention, the locking operation pipe 81 is included at an outer side of the shoulder part 30, and the shoulder part 30 is elevated respective to the button 40 through the locking operation pipe 81 so that the pressing operation of the button 40 can be locked or released. Accordingly, each initial installation position of the button 40 and the inner receptacle 12 can be continuously maintained while operating, and an initial assembling state between the button 40 and the pumping part 50 can be stably maintained.

In a state where the user catches the locking operation pipe 81, the button 40 is elevated through the operation of rotating the outer receptacle 11 so that an easy operation can be secured.

Also, the outer receptacle 11 is divided into the outer receptacle body part 11*a* and the locking ring 11*b*, and stopper protuberances 82 are formed at an inner surface of the locking ring 11*b*. Therefore, the structure of the outer receptacle 11 can be simple (in a case where the outer receptacle is integrally formed, a stopping protuberance is formed at an inner surface of the outer receptacle, and the bottom surface of the outer receptacle has to have a detachable structure).

Also, the channel closing wall part 32 is formed at the shoulder part 30 so that cosmetic can be prevented from leaking through the discharging channel 40*a* while being kept.

According to the present invention, the shoulder part is elevated respective to the button through the lock operation pipe included at an outer side of the shoulder part so that the pressing operation of the button can be locked or the locking is released.

Also, in a state where the locking operation pipe is held, the button is elevated through the operation of rotating an outer receptacle so that easy operation can be secured.

What is claimed is:

1. A cosmetic receptacle comprising:

a receptacle part including an outer receptacle having an opening part formed at an upper surface thereof and an inner receptacle which has a opening part formed at an upper surface thereof and is installed within the outer receptacle in such a manner that the upper surface opening part of the inner receptacle part is arranged in a same direction as the upper surface opening part of the outer receptacle part;

an inner cap which has a communicating hole and is assembled with an upper end of the inner receptacle so that the inner cap can close the upper surface opening part of the inner receptacle and move together with the inner receptacle in a state where the communicating hole communicates with an inner space of the inner receptacle;

a shoulder part which has a mounting hole and is arranged in such a manner that the mounting hole is arranged at an upper side of the communicating hole;

a button having a discharging channel formed at an interior of the button, the discharging channel being opened through a side surface and a lower surface of the discharging channel, the button being installed so as to approach and move away from the inner cap in a state where a lower opening end of the discharging channel is positioned toward the communicating hole;

a pumping part including a cylinder, which has an opening part formed at an upper surface of the cylinder and is installed in such a manner that the upper surface opening part communicates with the communicating hole, and a guide channel part including a guide channel which connects the discharging channel with an inner space of the cylinder and is interlocked with an pushing operation of the button so as to be opened/closed, the pumping part allowing liquid cosmetics kept within the inner receptacle to be squeezed out through the discharging channel when the button is pressed;

a button locking part reciprocally moving the shoulder part respective to the button so as to hold a pushing operation of the button when a user pushes the button, wherein the button locking part includes a locking operation pipe assembled with an outer surface of an upper end of the outer receptacle so as to rotate respective to the outer receptacle and a stopping protuberance protruding from an inner surface of the upper end of the outer receptacle, a locking operation groove being formed at the locking operation pipe, the locking operation groove including a lock keeping groove arranged at an upper area of the locking operation groove along a horizontal direction, a release keeping groove arranged at a lower area of the locking operation groove along a horizontal direction, and an elevation guide groove connecting the lock keeping groove with the release keeping groove in a linear direction, and wherein the shoulder part includes a stopper groove formed on the shoulder part along a longitudinal direction and an elevation leading protuberance formed at an outer surface of the shoulder part, the shoulder part is installed in such a manner that the stopping protuberance is inserted into the stopper groove, and the elevation leading protuberance is inserted into the locking operation groove.

2. The cosmetic receptacle as claimed in claim 1, wherein the outer receptacle includes an outer receptacle body part having a pipe-shape and a locking ring coupled with an inner surface of an upper end of the outer receptacle body part so as to rotate together with the outer receptacle body part, wherein the stopping protuberance is formed at an inner surface of the locking ring.

3. The cosmetic receptacle as claimed in claim 1, wherein the shoulder part includes a channel closing wall part formed at an upper surface of the shoulder so as to close an opening end of a side surface of the discharging channel when the elevation leading protuberance is inserted into the locking keeping groove.

* * * * *